US010420364B2

(12) United States Patent
Woodman et al.

(10) Patent No.: US 10,420,364 B2
(45) Date of Patent: Sep. 24, 2019

(54) TOBACCO TREATMENT

(71) Applicant: British American Tobacco (Investments) Limited, London (GB)

(72) Inventors: Thomas Woodman, London (GB); Arkadiusz Druzdzel, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 14/765,282

(22) PCT Filed: Jan. 31, 2014

(86) PCT No.: PCT/GB2014/050263
§ 371 (c)(1),
(2) Date: Jul. 31, 2015

(87) PCT Pub. No.: WO2014/125251
PCT Pub. Date: Aug. 21, 2014

(65) Prior Publication Data

US 2015/0366262 A1 Dec. 24, 2015

(30) Foreign Application Priority Data

Feb. 13, 2013 (GB) ..... 1302485.6

(51) Int. Cl.
*A24B 3/04* (2006.01)
*A24B 15/24* (2006.01)

(52) U.S. Cl.
CPC ..... *A24B 3/04* (2013.01); *A24B 15/24* (2013.01)

(58) Field of Classification Search
CPC ..... A24B 3/04
See application file for complete search history.

(56) References Cited

U.S. PATENT DOCUMENTS

| | | | | |
|---|---|---|---|---|
| 560,483 | A | 5/1896 | Brul | |
| 1,538,265 | A | 5/1925 | Arnold | |
| 3,943,942 | A | 3/1976 | Anderson | |
| 4,388,933 | A * | 6/1983 | Rainer | A24B 3/182 131/293 |
| 5,025,812 | A | 6/1991 | Fagg | |
| 5,099,864 | A | 3/1992 | Young et al. | |
| 5,144,967 | A * | 9/1992 | Cartwright | A24D 1/02 131/335 |
| 5,549,906 | A | 8/1996 | Santus | |

(Continued)

FOREIGN PATENT DOCUMENTS

| | | |
|---|---|---|
| BE | 859294 | 1/1978 |
| CN | 85104074 A | 11/1986 |

(Continued)

OTHER PUBLICATIONS

International Search Report and Written Opinion, dated May 9, 2014 for PCT/GB2014/050263, filed Jan. 31, 2014.

(Continued)

*Primary Examiner* — Eric Yaary
(74) *Attorney, Agent, or Firm* — Patterson Thuente Pedersen, P.A.

(57) ABSTRACT

A method of treating tobacco is disclosed. It comprises a first conditioning step wherein the moisture content of the tobacco is increased to a first level, and a second separate conditioning step wherein the pH of the tobacco is increased to at least pH 7.

16 Claims, 2 Drawing Sheets

(56) References Cited

U.S. PATENT DOCUMENTS

| | | | | |
|---|---|---|---|---|
| 5,598,868 | A * | 2/1997 | Jakob | A24B 15/14 131/352 |
| 5,783,207 | A | 7/1998 | Stanley | |
| 5,908,033 | A * | 6/1999 | Korte, Sr. | A24B 3/04 131/291 |
| 2003/0070687 | A1 | 4/2003 | Atchley | |
| 2003/0159702 | A1 | 8/2003 | Lindell | |
| 2004/0173228 | A1 | 9/2004 | Coleman, III | |
| 2005/0167536 | A1* | 8/2005 | Chojnacki | A24B 7/14 241/223 |
| 2008/0029117 | A1 | 2/2008 | Mua | |
| 2009/0025738 | A1 | 1/2009 | Mua et al. | |
| 2009/0025739 | A1 | 1/2009 | Brinkley et al. | |
| 2011/0139164 | A1 | 6/2011 | Mua | |
| 2011/0315154 | A1* | 12/2011 | Mua | A24B 15/12 131/309 |
| 2012/0006342 | A1 | 1/2012 | Rose | |
| 2012/0073588 | A1 | 3/2012 | Kawata | |
| 2012/0125354 | A1* | 5/2012 | Byrd | A24B 15/24 131/297 |
| 2013/0008458 | A1 | 1/2013 | Okada | |
| 2015/0189912 | A1 | 7/2015 | Bell | |
| 2015/0366262 | A1 | 12/2015 | Woodman et al. | |

FOREIGN PATENT DOCUMENTS

| | | | | |
|---|---|---|---|---|
| CN | 86103434 | | 11/1986 | |
| CN | 86102917 | A | 11/1987 | |
| CN | 1049275 | A | 2/1991 | |
| CN | 102499466 | | 6/2012 | |
| CN | 103005668 | | 4/2013 | |
| DE | 618359 | | 9/1935 | |
| EP | 2526787 | A1 * | 11/2012 | A24B 15/28 |
| EP | 2554059 | A1 | 2/2013 | |
| JP | 2013153755 | | 8/2013 | |
| RU | 2403831 | C1 | 11/2010 | |
| RU | 2403833 | C1 | 11/2010 | |
| RU | 2443131 | C1 | 2/2012 | |
| WO | WO 8602528 | A1 | 5/1986 | |
| WO | WO 2004008888 | A1 | 1/2004 | |
| WO | 2009/015142 | A2 | 1/2009 | |
| WO | WO 2010107613 | A1 | 9/2010 | |
| WO | WO 2013146952 | A1 | 10/2013 | |

OTHER PUBLICATIONS

Written Opinion of the IPEA, dated Feb. 24, 2015, for PCT/GB2014/050263, filed Jan. 31, 2014.

International Preliminary Report on Patentability, dated May 26, 2015 for PCT/GB2014/050263, filed Jan. 31, 2014.

Chinese Office Action, Application No. 201480051506.3, dated Jul. 4, 2017, 16 pages (25 pages with translation).

Household Ammonia MSDS (Material Safety Data Sheet, Household Ammonia Church & Dwight Co., Inc., https://www.conncoll.edu/media/website-media/offices/ehs/envhealthdocs/Ammonia.pdf, Published Feb. 22, 2001).

Sodium Hydroxide MSDS (Material Safety Data Sheet, Sodium Hydroxide Solution 5.0 N, Hach Company, www.nurnberg.com/images/245032-%20msds.pdf, Published Oct. 15, 2009).

Application and File History for U.S. Appl. No. 14/912,400, filed Feb. 16, 2016, Inventors: Bell et al.

PCT International Search Report for PCT/GB2014/052548, dated Nov. 11, 2014, 3 pages.

PCT Written Opinion of the International Searching Authority for PCT/GB2014/052548, dated Nov. 11, 2014, 6 pages.

PCT International Preliminary Report on Patentability for PCT/GB2014/052548, dated Jul. 28, 2015, 16 pages.

Definition of Solution, Merriam Webster Dictionary, https:www.meriam-webster.com/dictionary/solution, 12 pages, 2019.

U.S. Office Action, U.S. Appl. No. 14/912,400, dated Jan. 4, 2019, 14 pages.

* cited by examiner

TOBACCO TREATMENT

CLAIM FOR PRIORITY

This application is the National Stage of International Application No. PCT/GB2014/050263, filed Jan. 31, 2014, which in turn claims priority to and benefit of United Kingdom Patent Application No. 6131302485.6, filed Feb. 13, 2013. The entire contents of the aforementioned applications are herein expressly incorporated by reference.

TECHNICAL FIELD

The present invention relates to a method of treating tobacco. The treated tobacco is suitable for combustible and non-combustible tobacco industry products.

BACKGROUND

The primary process for preparing dried tobacco leaves for use in smoking articles involves a set of sequential operations. These operations include increasing the moisture level of dried tobacco leaves so that they can easily be cut or comminuted. Thereafter, the tobacco leaves are dried in order to reduce the moisture level so that the tobacco is suitable for making a smoking article such as a cigarette.

SUMMARY

According to an aspect of the invention, there is provided a method of treating tobacco comprising a first conditioning step wherein the moisture content of the tobacco is increased to a first level, and a second separate conditioning step wherein the pH of the tobacco is increased to at least pH 7.

The second conditioning step may involve increasing the pH of the tobacco to a range of pH 9 to 10.

In one embodiment, the second conditioning step involves adding an alkaline liquid solution comprising sodium salt to the tobacco.

In another embodiment, the first conditioning step involves increasing the moisture content of the tobacco to at least 19% MCWB, and the second conditioning step involves increasing the moisture content of the tobacco further so that it forms a slurry.

The moisture content may be increased to at least 25% MCWB during the second conditioning step.

In an alternative embodiment, the method further comprises a third step following the second conditioning step, and the third step involves processing the tobacco so as to prepare a tobacco extract.

In one embodiment, the method further comprises a heat treatment step to dry the tobacco.

The method may include the step of comparing an actual moisture content of tobacco subjected to heat treatment with a predetermined moisture content, the method further including the step of continuing the heat treatment step if the actual moisture content of the tobacco is above the predetermined moisture content.

In one embodiment, the tobacco is cut or comminuted after the first conditioning step but before the second conditioning step.

In another embodiment, the second conditioning step is carried out at a temperature ranging from 28 to 140° C., 28 to 95° C., 28 to 75° C. or 40 to 75° C.

The second conditioning step may be carried out at a pressure ranging from −35 bar(g) to +35 bar(g).

In some embodiments, the method includes the step of controlling the pressure so that it changes over time.

The method may include the step of vibrating the tobacco during the first and/or second conditioning step.

The method may include the step of exposing the tobacco to microwave energy during the first and/or second conditioning step.

The sodium salt may be sodium carbonate.

According to another aspect of the invention, there is provided a method of treating tobacco, comprising the step of increasing the moisture content of the tobacco and thereafter exposing the tobacco to heat treatment, subsequently determining the actual moisture content of the tobacco and comparing the actual moisture content with a pre-determined moisture content.

Preferably, the method includes the step of continuing the heat treatment if the actual moisture content of the tobacco is above the predetermined moisture content.

The temperature and the length of time of the heat treatment may be selected in dependence on the actual moisture content of the tobacco.

Preferably, the heat treatment does not exceed a temperature of 100° C.

The method may include the step of cooling the tobacco if the actual moisture content of the tobacco is below the predetermined moisture content.

According to one aspect of the invention, there is provided tobacco obtainable by the method as described above.

According to another aspect of the invention, there is provided use of tobacco obtained by the method as described above for manufacture of a tobacco industry product.

DETAILED DESCRIPTION

Embodiments of the present invention will now be described by way of example only, with reference to the accompanying drawings.

Embodiments of the invention seek to improve the primary process of preparing tobacco such that a tobacco product comprises a desirable amount of temperature-sensitive molecules producing a greater organoleptic effect on a user and reduced levels of certain constituents.

Figure 1:
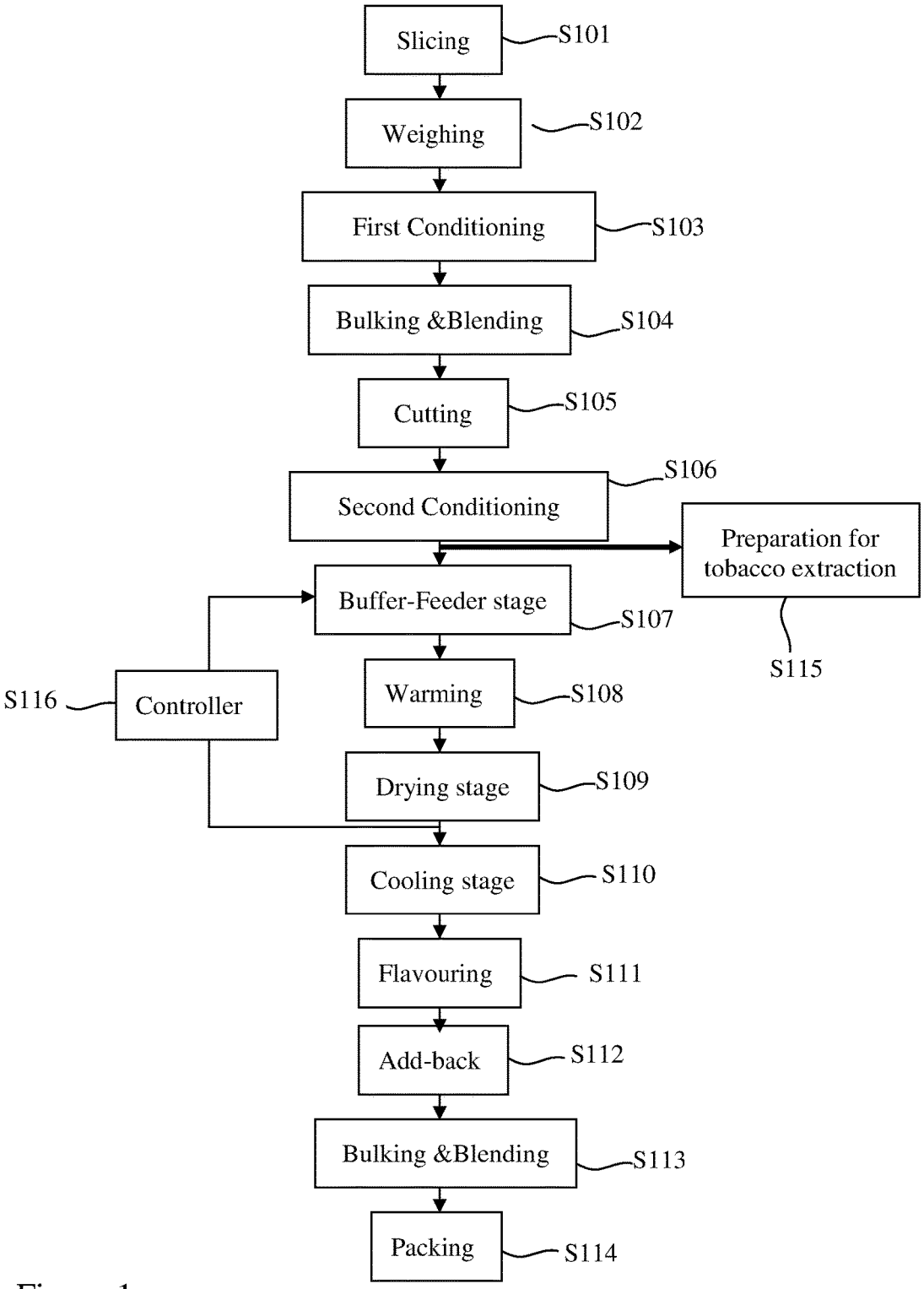
FIG. 1 shows a flow diagram of steps for a method of treating tobacco according to a first embodiment of the present invention.

Referring now to the drawings, there is shown in FIG. 1 a flow diagram of a method for treating tobacco according to a first embodiment. The method involves preparing and treating dried unprocessed tobacco leaves so as to produce cut tobacco which has an increased organoleptic effect on a user compared to tobacco prepared via conventional methods. The method comprises various sequential steps which are explained in more detail below.

The first step S101 of the method involves introducing a tobacco bale of dried unprocessed tobacco leaves into a slicer which slices or breaks up the tobacco bale into smaller pieces. At this stage, the tobacco typically has a moisture content of 8-12% MCWB and a pH of 5.2-6.5, although the method is not limited to processing tobacco of these characteristics.

In the next step, the tobacco is weighed S102 on a weightband. Thereafter, the tobacco is treated during a first conditioning step S103. The first conditioning step S103 involves the tobacco being introduced into a vessel, e.g. a direct conditioning cylinder (DCC), where it is exposed to saturated water steam for approximately 2 to 3 minutes such that the moisture content of the tobacco is increased from 8-12% MCWB to 19-22% MCWB. The tobacco can also be treated with a casing liquid either whilst it is located in the DCC or alternatively, the tobacco is fed from the DCC into a casing cylinder where it is treated with a casing liquid separately. The casing liquid lubricates the tobacco and typically comprises glycerine-based liquids, however it is not limited thereto.

In the next step, the tobacco is introduced into bulking and blending silos S104 during which the tobacco is blended and stored until the subsequent step. This step is particularly important when the tobacco comprises a blend of tobacco varieties because during the bulking and blending step the tobacco is mixed so as to form a uniform blend.

After the bulking and blending stage, the tobacco is passed through a cutter S105 so as to reduce the size of the tobacco leaves. For example, the tobacco may be cut into strips and/or grinded into e.g. flakes suitable for smoking articles such as cigarettes.

Following the step of cutting S105, the tobacco is further treated during a second conditioning step S106. This step involves the tobacco entering a conditioning drum where its pH is increased from approximately pH 5.2-6.5 to pH 7 or above, such as, pH 7.5, 8, 8.5, 9, 9.5, 10, 10.5, 11, 11.5, 12, 12.5, 13, 13.5 or 14. In one embodiment the pH is increased to pH 9 to 10. The pH of the tobacco is increased by adding an alkaline liquid solution. The liquid solution may be an aqueous solution or an organic solution comprising a salt. The salt may be a sodium salt such as sodium carbonate. For example, the solution may be an ethanol-based solution comprising sodium carbonate. Advantageously, ammonia is not used to increase the pH of the tobacco. By increasing the pH of the tobacco, the amount of desirable temperature-sensitive molecules in the tobacco is increased and less tobacco can be used in a tobacco product which results in a reduced level of certain constituents.

The second conditioning step S106 is carried out at a temperature between 28° C. to 140° C., in another embodiment the second conditioning step is carried out at a temperature ranging from 28° C. to 75° C. The second conditioning step S106 is carried out for at least 10 minutes. In one embodiment, the second conditioning step S106 is carried out for a period between 10 to 150 minutes depending on the tobacco blend. In another embodiment, the time range for the second conditioning process is 10 to 90 minutes.

Furthermore, the second conditioning process can be carried out at different pressures. For example, the second conditioning process can be carried out at ambient pressure. Alternatively a positive and/or a negative pressure may be applied. In one embodiment, the pressure is between and including −35 bar(g) to 35 bar(g). In another embodiment, the pressure is −15 bar(g) to 15 bar(g). A pressure sealed vessel, e.g. a drum is used when a pressure other than ambient pressure is applied during the second conditioning process. The pressure applied may be time-dependent ((p=ƒ(t), wherein p=pressure, ƒ=function, t=time). For example, the pressure may follow a cyclic profile with time such that the pressure alternates between positive and negative pressure, or alternatively the pressure may continuously change but remain positive, or alternatively remain negative. The pressure profile may differ depending on tobacco blend in order to optimise the speed of reaction between the tobacco and the added liquid solution.

In another un-illustrated embodiment, the second conditioning process S106 is carried out in inert gas and/or in a positive reaction synergy gaseous atmosphere. Similarly to above, the pressure may be atmospheric. Alternatively, a positive and/or a negative pressure may be applied. In one embodiment, the pressure range is −35 bar(g) to 35 bar(g). The pressure may also be time dependent such that it is a function of time (p=ƒ(t), wherein p=pressure, ƒ=function, t=time) as described above.

The second conditioning step of any of the above described embodiments can be further modified by altering the pressure and the temperature so as to control the reaction speed. The speed of reaction can be increased by elevating the temperature and the pressure. In one embodiment, the temperature of the second conditioning step S106 is between 40 to 75° C. at close to atmospheric pressure.

The properties of the tobacco can be further altered by applying vibrations to the tobacco during whole or parts of the second conditioning process S106. The vibrations may be of any frequency, however in one embodiment the vibrations are macroscopic. The vibrations intensify the second conditioning process and accelerate the rate of reaction.

The properties of the tobacco can also be altered by applying microwaves to the tobacco during whole or parts of the second conditioning process S106. The microwaves intensify the second conditioning process and accelerate the rate of reaction.

The second conditioning step causes the moisture content of the tobacco to increase to 25-55% MCWB because of alkaline liquid solution being added to the tobacco to alter its pH. In one embodiment, the moisture content is increased to at least 27%, 30%, 35%, 40%, 45% or 50% MCWB.

Advantageously, by increasing the moisture level of the tobacco during the second conditioning step as described above, the tobacco forms a fluid mixture or a slurry. This slurry can be further processed so as to produce a tobacco extract for non-combustible tobacco products such as inhalers or other tobacco extract delivery devices. This is represented by step S115 in FIG. 1.

When preparing tobacco for combustible tobacco products such as cigarettes the next step after the second conditioning process is to expose the tobacco to a heat treatment. The heat treatment involves three individual steps; buffer-feeder S107, warming and/or expanding tunnel S108 and a drying stage S109 as will now be described in more detail.

After the second conditioning step S106, the tobacco is passed to a buffer-feeder S107 which controls the mass flow rate of tobacco to the warming and/or expanding tunnel S108. The buffer-feeder S107 feeds a uniform carpet of tobacco into the warming or expanding tunnel S108 where a substantial amount of ammonia naturally present in tobacco is removed. The warming tunnel comprises a vibrating tray or a rotating drum which warms up the slurry to 60-95° C. At this temperature range ammonia evaporates from the tobacco, however the temperature is sufficiently low to avoid expansion of the tobacco. Furthermore, superheated steam and/or hot air is used to heat the slurry so as not to increase the moisture content further as this would prolong the subsequent drying stage S109. The super heated steam and/or hot air also assists in mixing of the tobacco.

After the warming tunnel S108, the tobacco enters the drying stage S109. During this step, the tobacco is passed into a drying drum which heats the tobacco to 100° C. At this temperature, water will evaporate such that the moisture content is reduced, however the temperature is not increased beyond 100° C. as this would cause the tobacco to expand and the components of the alkaline liquid solution added during the second conditioning step S106 to evaporate.

The drying stage S109 lasts for a pre-determined length of time, after which the tobacco enters a cooling stage S110 where the tobacco is cooled.

In one embodiment, the method further involves a controller and a moisture content reader. The controller operates the moisture content reader so as to determine the moisture content of the batch of tobacco exiting the drying drum of the drying stage S109 as is represented by S116. The controller compares the moisture content of the tobacco with a predetermined value, for example 14.5% MCWB. If the controller determines that the moisture content of the tobacco is above the predetermined value, for example, above 14.5% MCWB, then the controller redirects the batch of tobacco back to the buffer-feeder S107 where the tobacco is passed through the heat treatment warming tunnel S108 and the drying stage S109 again. This process is repeated until the controller determines that the tobacco exiting the drying stage S109 has a moisture content below the predetermined value (for example, below 14.5% MCWB). Thereafter, the tobacco enters the cooling stage S110 during which the tobacco is cooled down.

If the controller determines that the tobacco has to be fed through the heat treatment another time, the controller can adjust the temperature and the length of time of the subsequent heat treatment so as to tailor the heat treatment to the specific characteristics of the tobacco.

The tobacco may be exposed to vibration during the whole or parts of the heat treatment. This ensures that the tobacco is homogeneously exposed to the heat treatment resulting in uniform removal of ammonia from the tobacco.

As described above, after the heat treatment the tobacco enters the cooling stage S110 during which the tobacco is cooled down. Thereafter, flavourant may be added to the tobacco as represented by step S111 in the flow diagram. Furthermore, particles of tobacco-based products, such as reconstituted tobacco (recon), burley tobacco, dust and/or CRS, may be introduced into the processed tobacco as represented by step S112. The tobacco is then passed on to bulking and blending silos S113 where the tobacco is further mixed and stored ready for being packaged S114 and used in manufacturing of smoking articles such as cigarettes.

It should be understood that the present invention is not limited to the above steps and their sequential order. For example, the step of slicing S101 and the weightband S102 are optional and are only preferred when the tobacco that is to be treated is unprocessed, uncut, and bundled into bales.

Furthermore, the step of the warming tunnel S108 is also optional as a substantial level of ammonia naturally present in the tobacco will evaporate and be removed from the tobacco during the drying step S109.

Steps S111 and step S112 relating to adding flavourant and particles of tobacco-based products, respectively, are also optional. The particles of tobacco-based products can be added throughout the process, however in one embodiment the particles are added before either or both of the bulk and blending steps S104, S113. However, in an alternative embodiment, the particles of tobacco-based products are added during the second conditioning step S106. In yet another embodiment, particles of tobacco-based products are added during the second conditioning step S106 and after the heat treatment.

It should also be appreciated that the embodiment described above is not limited to comprising the steps of the bulking and blending silos S104 and S113. These steps are preferred when the tobacco comprises more than one tobacco variety, particles of tobacco-based products have been added to the tobacco, and/or if the tobacco needs to be temporarily stored in between two steps.

It should be appreciated that the second conditioning step S106 is arranged to occur after the step of cutting S105 rather than the before, because the moisture content of the tobacco after the second conditioning step S106 is too high so as to enable the tobacco to be effectively cut by the cutter. Furthermore, it is undesirable to combine the first and second conditioning steps because if the tobacco is cut before the conditioning it will disintegrate because it is too dry, brittle and fragile. Moreover, the tobacco is unsuitable to be cut immediately after the combined conditioning step because the tobacco is then in the form of a slurry which is too moist to be effectively cut by the cutter. Therefore, it is advantageous not to combine the first and the second conditioning step.

It is also envisaged that different batches of treated tobacco can be blended, in particular where the parameters of the first and/or second conditioning steps S103, S106 have been different for different batches.

The aforementioned embodiments are advantageous over the prior art described in the introduction because the method of treating tobacco can be used for both combustible and non-combustible tobacco. Furthermore, the second conditioning step S106 obviates the need to use ammonia to enhance the organoleptic effect provided by the tobacco.

Figure 2:
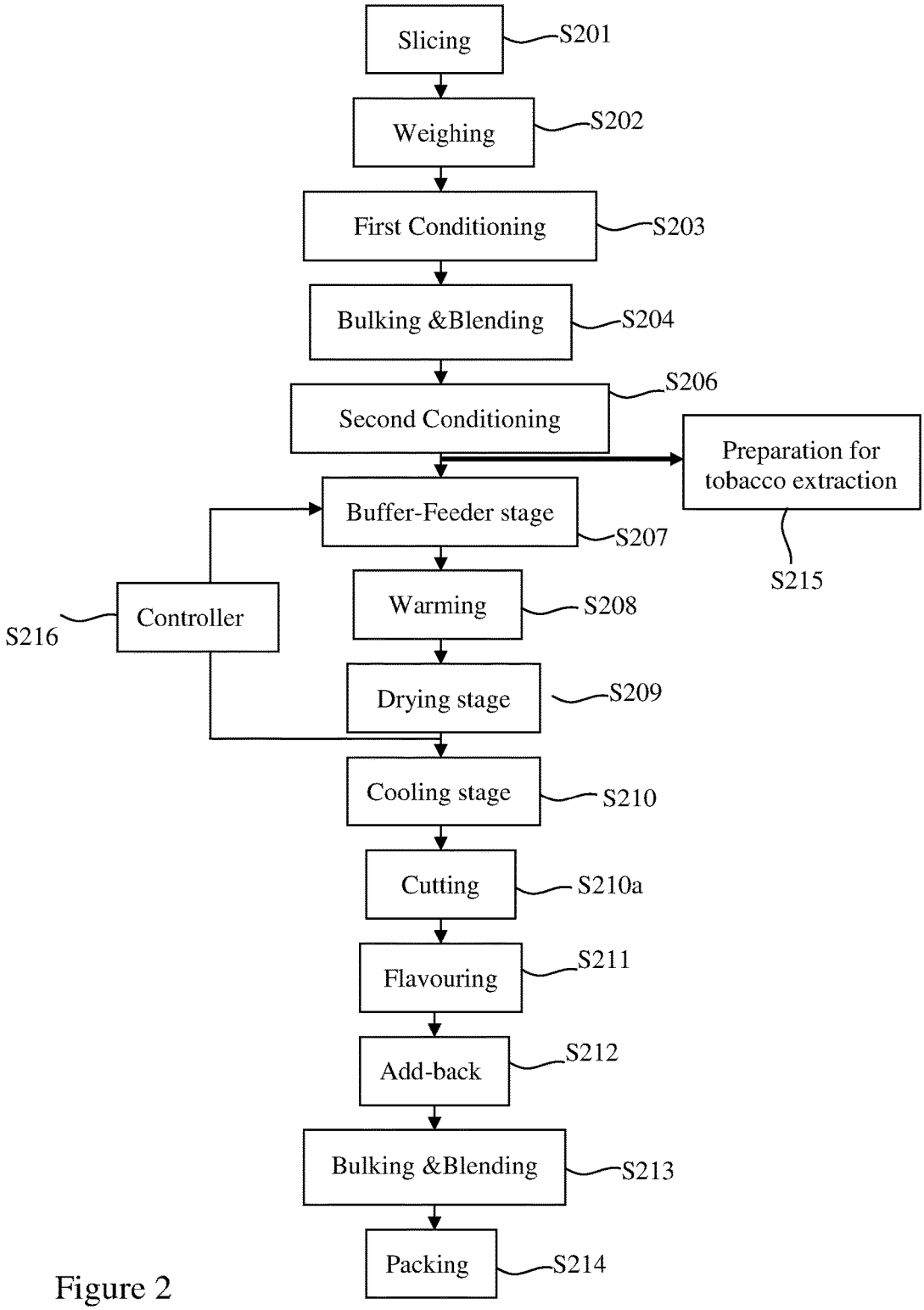
FIG. 2 shows a flow diagram of steps for a method of treating tobacco according to a further embodiment of the present invention.

Referring now to FIG. 2, another embodiment of a method of treating tobacco is shown. In this embodiment, dried tobacco leaves are processed so as to produce strips of tobacco. This embodiment is similar to the embodiment described with reference to FIG. 1, and comprises the steps of slicing S201, weighing S202, first conditioning S203, bulking and blending S204, second conditioning S206, buffer-feeder stage S207, warming and/or expansion S208, drying stage S209, cooling stage S210, cutting **S210*a*, flavouring S211, add-back S212, bulk and blending S213 and packaging S214. It should be understood that each of these steps correspond to the relevant step described with reference to FIG. 1. However, the embodiment shown in FIG. 2 differs in that the step of cutting S210*a* the tobacco occurs after the heat treatment or more specifically after the cooling stage S210, and that the step of cutting S210*a* involves cutting the tobacco into larger strips. Thus, this embodiment comprises the same advantages as those described with reference to FIG. 1. Furthermore, this embodiment can be used for treating combustible and non-combustible tobacco, in particular, the embodiment also includes the option of preparing tobacco extracts as represented by step S215 similar to the step S115 described with reference to FIG. 1**.

It should be understood that the embodiment described with reference to FIG. 2 may comprise any of the optional features described with reference to FIG. 1.

In an alternative un-illustrated embodiment, the method of treating tobacco is the same as the embodiment described with reference to FIG. 1, however in this embodiment the method does not involve a cutting stage, instead whole tobacco leaves are treated. Also this embodiment may comprise any of the optional features described with reference to FIG. 1.

During the second conditioning step S106, S206 as described in any of the embodiments above, volatiles may be released. Furthermore, ammonia naturally present in tobacco is released during the heat treatment. Therefore, the second conditioning step S106, S206, buffer-feeder S107, S207, warming tunnel S108, S208 and drying stage S109, 209 can be carried out in a controlled environment where it is enclosed and ventilated via an air-outlet connected to a filter which removes the ammonia and volatile substances from the air.

Vibrations can be applied to the whole process or any part of the process so as to ensure that the tobacco is evenly distributed resulting in a more homogenous end product.

The tobacco produced by the method according to the present invention comprises an increased level of temperature-sensitive molecules compared to tobacco produced by conventional methods. Therefore, tobacco industry products comprising tobacco produced by the method according to the present invention can be manufactured to comprise less tobacco. As a result, a user consuming such a tobacco industry product is exposed to a lower level of certain constituents compared to conventional tobacco industry products.

As used herein, the terms "flavour" and "flavourant" refer to materials which, where local regulations permit, may be used to create a desired taste or aroma in a product for adult consumers.

In order to address various issues and advance the art, the entirety of this disclosure shows by way of illustration various embodiments in which the claimed invention(s) may be practiced and provide for superior tobacco for combustible and non-combustible tobacco products. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and modifications may be made without departing from the scope and/or spirit of the disclosure. As such, all examples, implementations, and/or embodiments are deemed to be non-limiting throughout this disclosure. Also, no inference should be drawn regarding those embodiments discussed herein relative to those not discussed herein other than it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, function, features, structural, and/or other aspects of the disclosure are not to be considered limitations on the disclosure as defined by the claims or limitations on equivalents to the claims.

The invention claimed is:

1. A method of treating tobacco, the method comprising:

a first conditioning step including increasing a moisture content of a tobacco to a first moisture level of at least 19% on a Moisture Content Wet Basis (MCWB);

after the first conditioning step and before any other step that substantially modifies the MCWB of the tobacco, cutting or comminuting the tobacco at the first moisture level; and immediately after cutting or comminuting the tobacco, a second separate conditioning step including increasing a pH of the tobacco to at least pH 7 to retain the organoleptic effect of the tobacco leaves.

2. The method according to claim 1, wherein the second conditioning step includes increasing the pH of the tobacco to within a range of pH 9 to 10.

3. The method according to claim 1, wherein the second conditioning step includes adding an alkaline liquid solution including sodium salt to the tobacco.

4. The method according to claim 1, wherein the second conditioning step includes increasing the moisture content of the tobacco to at least 25% MCWB.

5. The method according to claim 1, the method further comprising a third step following the second conditioning step, the third step including processing the tobacco to prepare a tobacco extract.

6. The method according to claim 1, the method further comprising drying the tobacco by heat treatment.

7. The method according to claim 6, further comprising:

comparing an actual moisture content of tobacco subjected to heat treatment with a predetermined moisture content; and continuing the heat treatment if the actual moisture content of the tobacco is above the predetermined moisture content.

8. The method according to claim 1, wherein the second conditioning step is carried out at a temperature ranging from 28 to 140° C.

9. The method according to claim 1, further comprising:

exposing the tobacco to heat treatment after said first and second conditioning steps; and subsequently determining an actual moisture content of the tobacco and comparing the actual moisture content with a predetermined moisture content.

10. The method according to claim 9, further comprising continuing the heat treatment if the actual moisture content of the tobacco is above the predetermined moisture content.

11. The method according to claim 10, wherein a temperature of the heat treatment and a length of time of the heat treatment are selected in dependence on the actual moisture content of the tobacco.

12. The method according to claim 11, wherein the temperature of the heat treatment does not exceed 100° C.

13. The method according to claim 9, further comprising cooling the tobacco if the actual moisture content of the tobacco is below the predetermined moisture content.

14. The method according to claim 8, wherein the second conditioning step is carried out at a temperature ranging from 28 to 95° C.

15. The method according to claim 8, wherein the second conditioning step is carried out at a temperature ranging from 28 to 75° C.

16. The method according to claim 8, wherein the second conditioning step is carried out at a temperature ranging from 40 to 75° C.

* * * * *